US006289855B1

(12) United States Patent
Romblom et al.

(10) Patent No.: US 6,289,855 B1
(45) Date of Patent: Sep. 18, 2001

(54) ENGINE BLOCK FOR INTERNAL COMBUSTION ENGINE

(75) Inventors: Edward Robert Romblom, De Witt; James R. Williams, Beverly Hills, both of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/481,856

(22) Filed: Jan. 12, 2000

(51) Int. Cl.[7] ..... F02B 75/18
(52) U.S. Cl. ..... 123/41.74; 123/41.72
(58) Field of Search ..... 123/41.74, 41.72, 123/41.79

(56) References Cited

U.S. PATENT DOCUMENTS 4,382,427 * 5/1983 Lyndburst ..... 123/41.74
4,582,028 * 4/1986 Wagner et al. ..... 123/41.82 R
4,856,462 * 8/1989 Ushio et al. ..... 123/41.84
5,188,071 * 2/1993 Han ..... 123/195 R
5,542,381 8/1996 Noda et al. ..... 123/41.74

* cited by examiner

*Primary Examiner*—Tony M. Argenbright
*Assistant Examiner*—Katrina B. Harris
(74) *Attorney, Agent, or Firm*—Laura C. Hargitt

(57) ABSTRACT

An internal combustion engine includes a siamese engine block having cylinders defined by cylinder walls arranged in series with adjoining cylinders sharing a common wall. The engine block has a coolant jacket defined by a coolant jacket wall radially positioned parallel to and outboard of the cylinder walls to define a coolant passage for coolant flow through the engine block. The coolant passage includes an arc passage and a V-bend passage where the V-bend passage is adjacent the common wall of the adjoining cylinders. The V-bend passage is configured as a narrow rectangular portion having a coolant pocket projecting inboard from the rectangular portion into the common wall to provide heat transfer from the common wall of the cylinder. The cylinder wall includes a protrusion extending into the arc passage and disrupts flow from about the upper one-half of the coolant pocket.

6 Claims, 4 Drawing Sheets

ENGINE BLOCK FOR INTERNAL COMBUSTION ENGINE

TECHNICAL FIELD

The present invention relates to an engine block for an internal combustion engine.

BACKGROUND OF THE INVENTION

Internal combustion engines generally have an engine block with multiple engine cylinders arranged in series. The cylinders are cooled by coolant flowing through an adjacent coolant jacket. The coolant jacket includes a coolant jacket wall approximately parallel to the cylinder wall, defining a coolant passage therebetween.

Coolant enters the engine block at one end, flows through the coolant passage along both sides of the cylinders, exits the block at the opposing end, and transfers up into the cylinder head to flow through the head. This is referred to as a "U-flow" pattern. Alternatively, the coolant may flow through the head first before transferring to the block. While U-flow provides balanced heat transfer cylinder-to-cylinder because it provides a consistent coolant mass flow rate past each cylinder, it may not provide uniform heat transfer around each individual cylinder.

Some engine blocks include cooling slots between adjacent cylinders, allowing coolant to flow around the whole outer circumference of the cylinders to provide more consistent heat transfer from the cylinder wall. In siamese engine blocks where adjoining cylinders share a common cylinder wall therebetween to conserve lengthwise packaging space required for the engine block, a cooling slot is not included and coolant cannot flow between the cylinders. Therefore, heat transfer out of the cylinder is not as efficient in the circumferential area of the common cylinder wall.

Since the cylinder wall and coolant jacket wall determine the coolant passage shape, a horizontal section therethrough translates into repeated arcs in a Siamese engine block. Where adjacent cylinders meet at their shared cylinder wall, a vertical V-shaped groove is defined which creates a V-bend in the coolant passage. The liquid flow through the V-bend area is reduced due to the bend in the flow path. This stagnant flow translates into a reduced rate of heat dissipation in the common wall between the adjoining cylinders. A minimum coolant flow rate of approximately 1.5 meters/second is needed to provide the desired convective heat transfer from the cylinder walls when the engine is operating at peak torque.

A constant rate of cooling throughout the block is desired to reduce the effects of local thermal expansion such as distortion between a cylinder bore and its piston which may cause increases in oil consumption. Further, overall heat transfer from the piston improves piston ring durability and reduces spark knock tendencies.

A further consideration for the cooling system is the volume of coolant pumped throughout the engine. The more coolant a system demands for adequate cooling, the greater capacity coolant pump is needed. In addition, during engine cold starts, the more coolant there is, the longer it takes for the engine to warm to the optimum operating temperature.

Therefore it is desirable to optimize an engine block to promote adequate coolant flow therethrough and in particular in the V-bend area of the coolant passage where adjoining cylinders meet for uniform heat transfer about an individual cylinder, while minimizing the system volume of coolant required.

SUMMARY OF THE INVENTION

The present invention provides a siamese engine block having a coolant jacket which promotes coolant flow in the V-bend region of the coolant passage where cylinders join. In particular, the coolant passage is comprised of arc-shaped passages about the cylinders with V-bend passages therebetween where adjoining cylinders share a common wall. The V-bend passage vertical cross section includes a tall narrow rectangular portion having coolant pocket projecting inboard into the common wall. The coolant pocket allows coolant to flow about more circumferential area around each cylinder, particularly where the cylinders meet and in the upper combustion region.

The coolant passage further includes a protrusion projecting from the cylinder downstream of the coolant pocket. The protrusion forces coolant to flow from the top of the coolant jacket between cylinder bores, which is a higher pressure area, to the bottom of the coolant jacket between cylinder bores, a low pressure area, in the direction of the cylinder axis. This flow path promotes enhanced coolant flow in the narrow V-bend region between the bores thereby providing increased cooling.

DESCRIPTION OF THE PREFERRED EMBODIMENT

Figure 1:
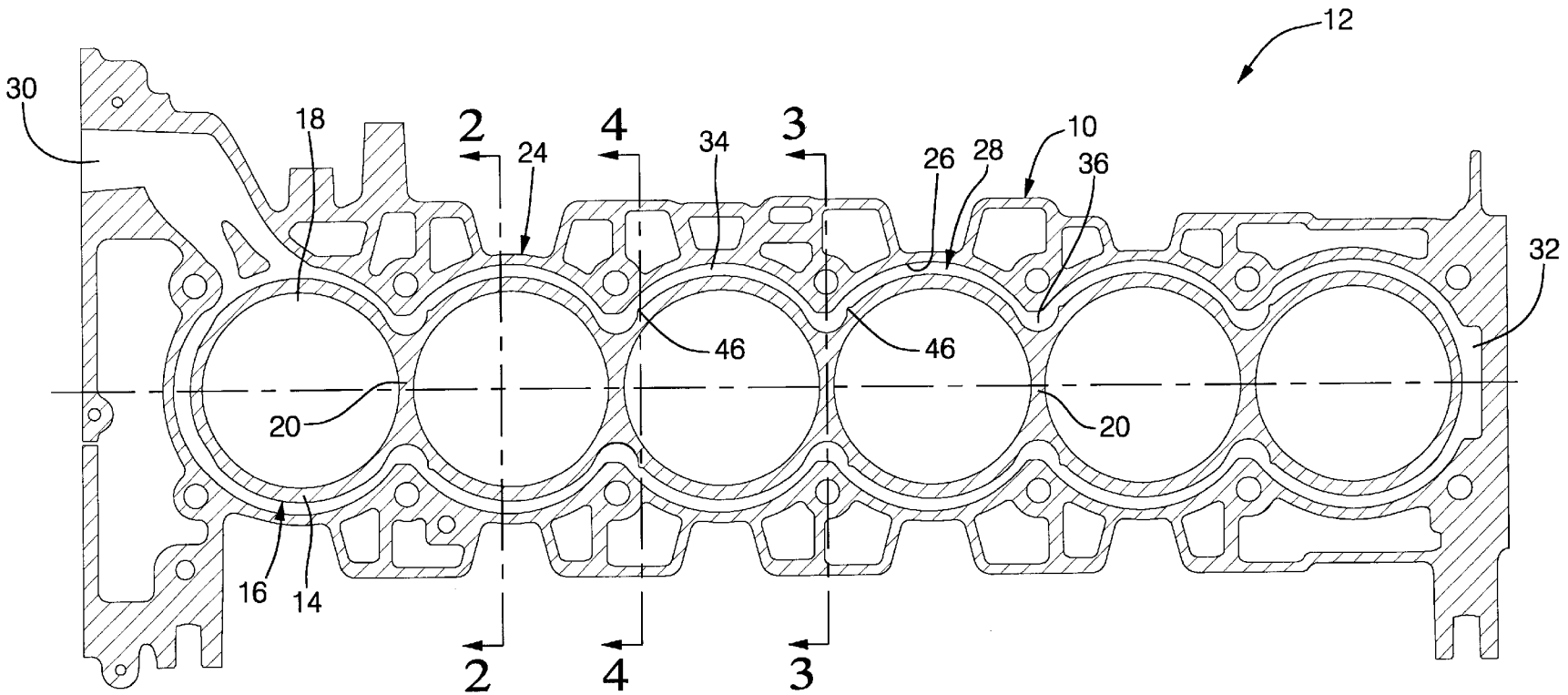
FIG. 1 is a horizontal sectional view of an engine block embodying the present invention.

As illustrated in the cross sectional view of FIG. 1, a siamese engine block 10 of an internal combustion engine, generally 12, has several cylinders 14 arranged in series. Each cylinder 14 is provided with a cylinder wall 16 which defines a cylinder bore 18 where a piston, not shown, reciprocates during operation. The cylinders 14 are laid out in a siamese configuration with adjoining cylinders sharing a common wall 20, like a septum, where the cylinders join.

To cool the cylinders 14, an adjacent coolant jacket 24 is provided. The coolant jacket 24 includes a coolant jacket wall 26 which is generally parallel to the cylinder walls 16 and spaced radially therefrom to create a coolant passage 28. The coolant jacket 24 also includes an inlet 30 at one end of the engine block 10 and an outlet 32 at the second end of the block. A coolant pump, not shown, pumps coolant through the block 10 from the inlet 30 to the outlet 32, defining a flow path through the coolant passage 28.

As best illustrated in the horizontal cross section of FIG. 1, the coolant passage 28 about each cylinder 14 is comprised of two uninterrupted portions, an arc passage 34 and a V-bend passage 36, adjacent to the common wall 20 between adjoining cylinders. The coolant passage 28 translates into repeated arcs 34 with the V-bend regions 36 therebetween.

Figure 2:
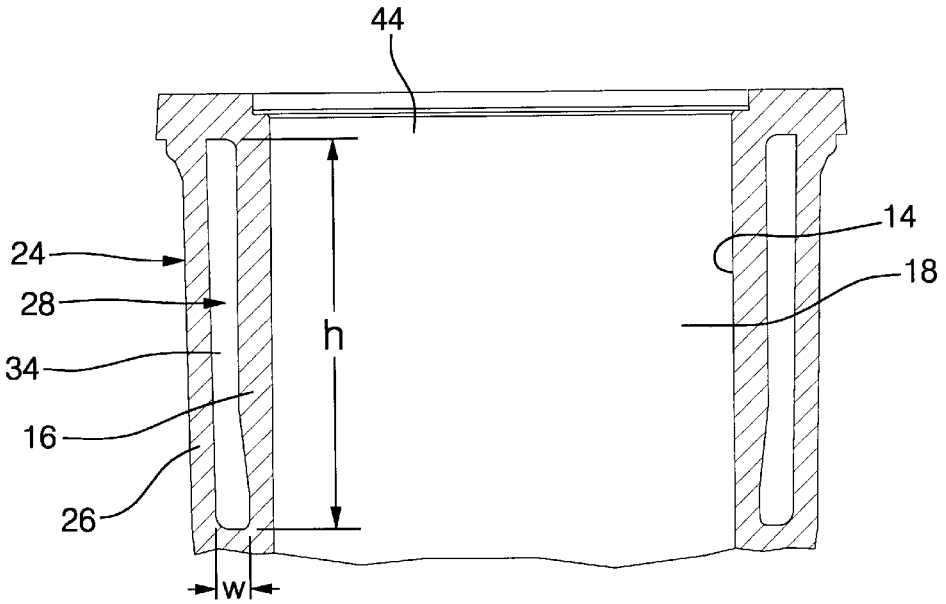
FIG. 2 is a vertical sectional view of the engine block taken along line 2—2 in FIG. 1, through the centerline of a cylinder.

The vertical cross sections of the coolant passage 28 will be described next. As illustrated in FIG. 2, the vertical cross section of the arc passage 34 is a tall, narrow rectangular shape. The height h of the arc passage 34 is approximately 80 percent of the height of the cylinder bore 18. The recommended width w of the arc passage 34 is less than or equal to 12 mm, and preferably closer to 8 mm. Such a narrow passage helps to control the total volume of coolant needed to pass through the engine. It is desirable to minimize the total volume so that a greater capacity coolant pump is not required. Also, engine warm-up from a cold start is quicker with less coolant to heat.

Figure 3:
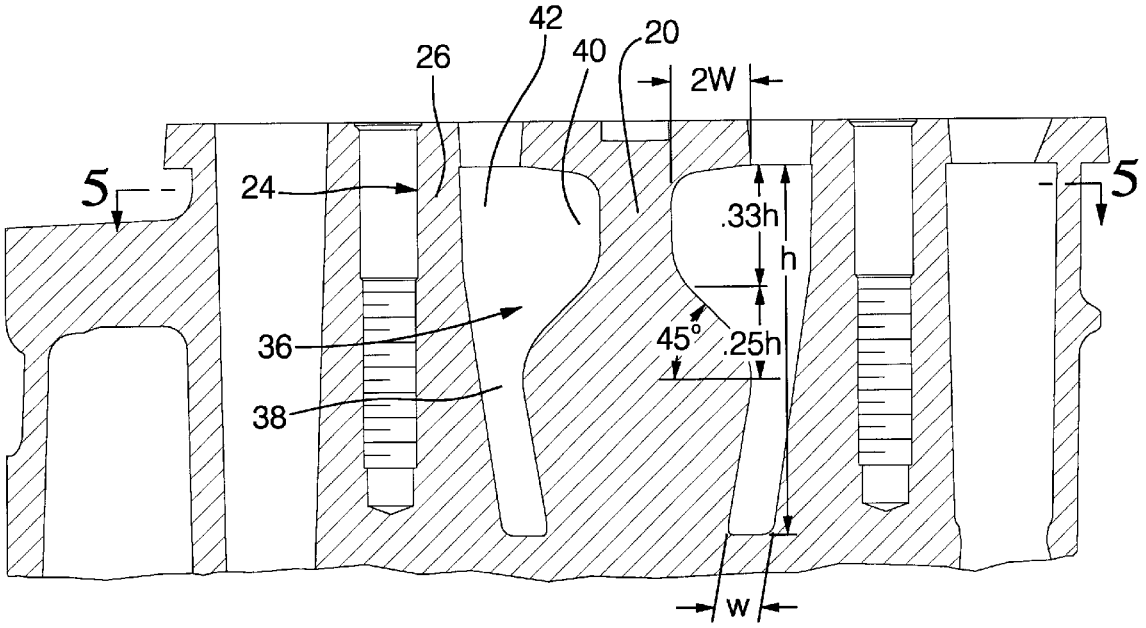
FIG. 3 is a vertical sectional view of the engine block taken along line 3—3 in FIG. 1, through a common cylinder wall.

The V-bend passage 36, adjacent the shared common wall 20, has a significantly different vertical cross section than the arc passage 34 to promote coolant flow in this region. As shown in FIG. 3, the cross section transitions from the narrow rectangular section of the arc passage 34 to a narrow generally rectangular portion 38 having an upper coolant pocket 40 projecting inboard into the common wall 20. The section is basically "P-shaped". The narrow rectangular portion 38 has width w and height h, which approximate the dimensions of the arc passage 34, and may include a draft angle for manufacturing. The coolant pocket 40 projects inboard from near the upper end 42 of the narrow rectangular portion 38. The approximate dimensions of the pocket 40 are a width of 2 w and a height of 0.33 h, and transitions into the rectangular portion 38 at a forty-five degree angle over a height of 0.25 h. The relative dimensions described are to be taken as approximations or guidelines. Each particular engine block may require further optimization which may not precisely replicate the ratios as described herein.

The coolant pocket 40 in the V-bend passage 36 allows coolant to circulate about a majority of the circumferential area of each cylinder 14 in the combustion region 44, FIG. 2, where combustion occurs in the cylinder. This provides more consistent heat transfer about each individual cylinder 14.

Figure 4:
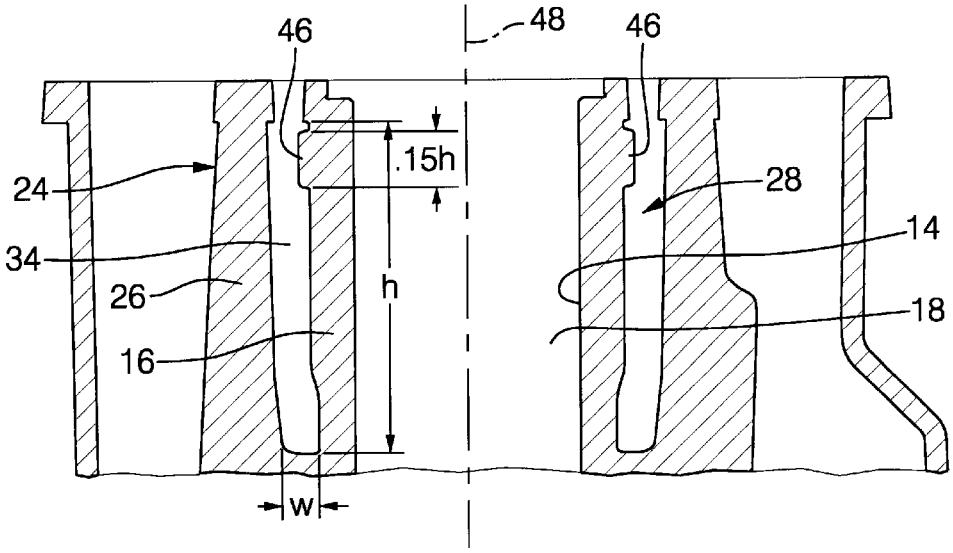
FIG. 4 is a vertical sectional view of the engine block taken along line 4—4 in FIG. 1, through a protrusion.
Figure 5:
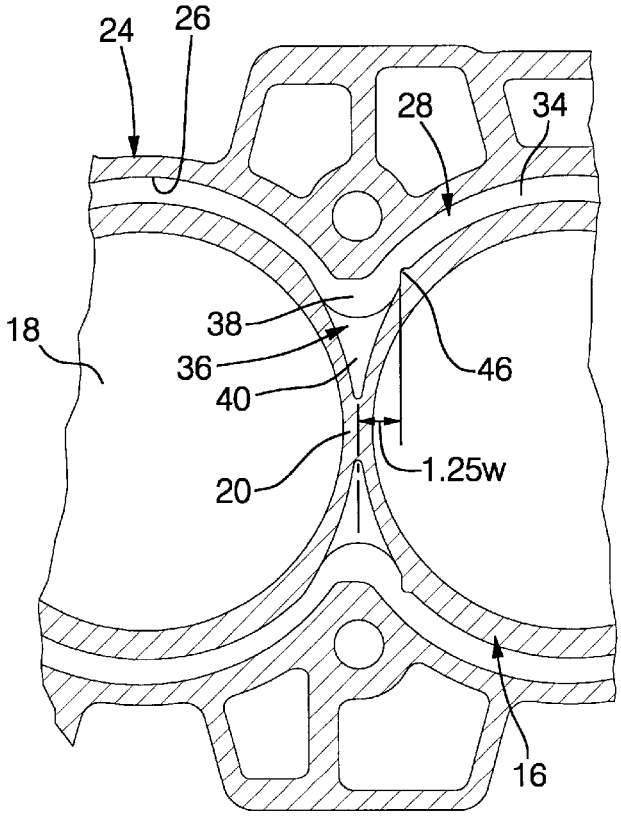
FIG. 5 is a horizontal sectional view of the engine block taken along line 5—5 in FIG. 3, through the coolant pocket.

To further promote coolant flow through the V-bend passage 36, a protrusion 46 is cast into the cylinder wall 16 and projects into the coolant arc passage 34 downstream of the V-bend passage, as shown in FIGS. 4 and 5. Preferably the protrusion 46 extends to about one-half the width of the arc passage 34 and restricts flow coming from the upper one-half of the pocket 40. The protrusion 46 may be a triangular wedge with approximate relative dimensions of 0.8 w for sides with a height of 0.15 h. It is located a distance about 1.25 w downstream of the centerline of the common wall 20. Alternatively, the protrusion 46 may be cast into the coolant jacket wall 24 to project into the coolant arc passage 34.

In operation, the coolant pump circulates coolant through the engine block coolant jacket 24 from the inlet 30 to the outlet 32. The coolant flows through the narrow rectangular arc passages 34, which account for approximately 50% of the circumferential area of the cylinder wall 16, and through the V-bend passages 36 connecting the repeated arc passages 34. To allow for greater cooling of the circumferential area of the bore 18 along the common wall 20, the V-bend passage 36 includes the coolant pocket 40 which extends into the common wall.

To further increase the flow rate through the V-bend passage 36, the protrusion 46 in the arc passage 34, downstream and adjacent the V-bend, creates an eddy in the pocket 40. The protrusion 46 effectively acts like a "speed-bump" and restricts flow which creates a high pressure region near the upper end 42 of the V-bend passage 36. The high pressure causes a portion of the coolant to flow from the pocket 40 and down in the narrow rectangular portion 38 between the cylinders 14, along the cylinder axis 48, FIG. 4.

Figure 6:
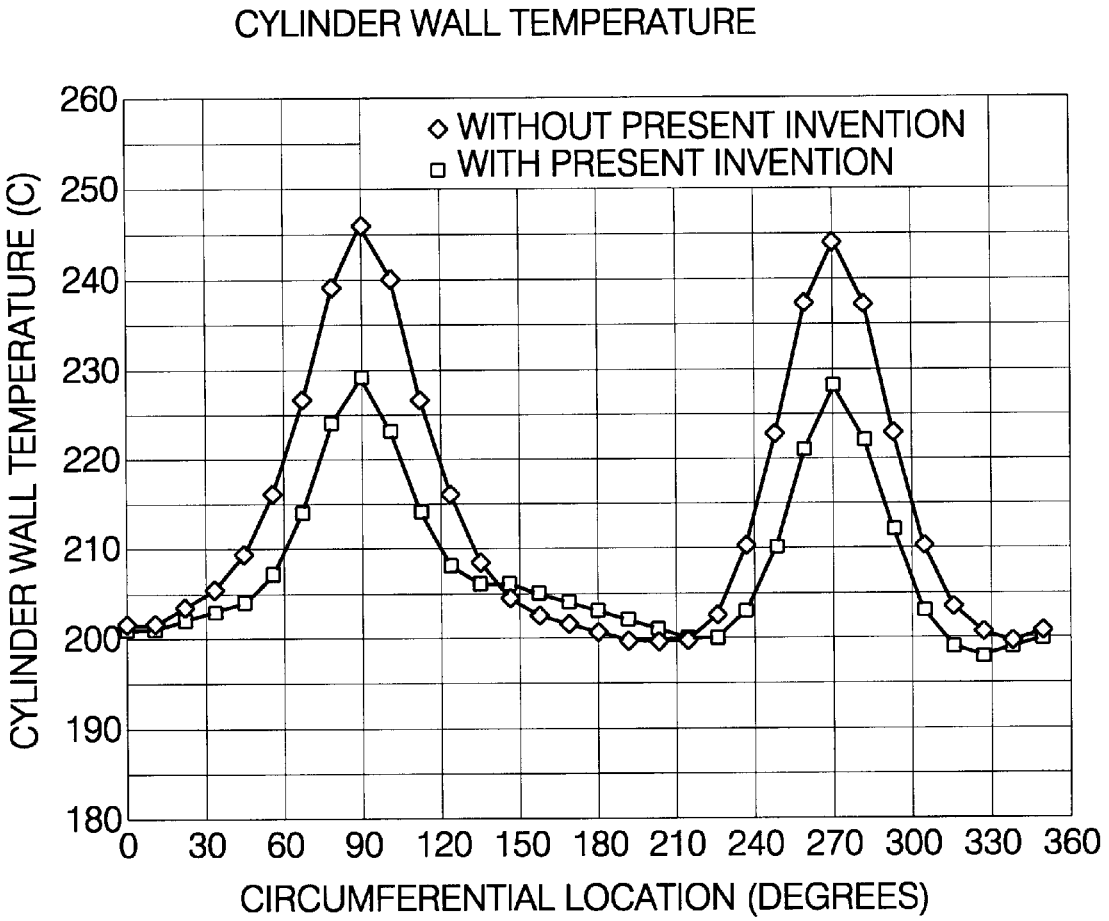
FIG. 6 is an analytical data comparison of cylinder wall temperatures about the cylinder circumference with and without the present invention.

The graph in FIG. 6 demonstrates the positive effects of increasing the coolant flow in the V-bend passage 36 with the coolant pocket 40 and the protrusion 46. The temperatures of the common walls, at circumferential locations 90 and 270 degrees, were reduced by about 15 degrees C. as compared to a coolant jacket without these features. Therefore the coolant pocket and protrusion act to significantly enhance the heat transfer capability in the region between adjoining cylinders.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. An internal combustion engine, comprising:

a siamese engine block having cylinders defined by cylinder walls arranged in series with adjoining cylinders sharing a common wall, said engine block having a coolant jacket defined by a coolant jacket wall radially positioned parallel to and outboard of said cylinder walls to define a coolant passage for coolant flow through said engine block, said coolant passage including an arc passage and a V-bend passage where said V-bend passage is adjacent said common wall of said adjoining cylinders, said V-bend passage configured as a narrow rectangular portion having a coolant pocket projecting inboard from said rectangular portion into said common wall to provide heat transfer from said common wall of said cylinder.

2. An internal combustion engine, as defined in claim 1, wherein said coolant pocket projects from an upper end of said narrow rectangular portion of said V-bend passage to promote heat transfer from a combustion region of said cylinder.

3. An internal combustion engine, as defined in claim 2, wherein said coolant pocket projects into said common wall for a width approximately twice as wide as said narrow rectangular portion of said V-bend passage.

4. An internal combustion engine, as defined in claim 3, wherein said arc passage has a narrow rectangular cross section with a width of approximately 12 mm or less for quicker engine warm-up.

5. An internal combustion engine, as defined in claim 4, wherein said cylinder wall further comprises a protrusion extending into said arc passage downstream of and adjacent to said V-bend passage and extends approximately one-half the width of said arc passage to disrupt flow from approximately the upper one-half of said coolant pocket and to create a pressure rise upstream of said protrusion in said coolant pocket of said V-bend passage to promote flow into said narrow rectangular portion thereby increasing the total flow rate of coolant through said V-bend passage and increasing heat transfer out of said common wall of said adjoining cylinders.

6. An internal combustion engine, as defined in claim 1, wherein said cylinder wall further comprises a protrusion extending into said arc passage downstream of and adjacent to said V-bend passage and extends approximately one-half the width of said arc passage to disrupt flow from approximately the upper one-half of said coolant pocket and to create a pressure rise upstream of said protrusion in said coolant pocket of said V-bend passage to promote flow into said narrow rectangular portion thereby increasing the total flow rate of coolant through said V-bend passage and increasing heat transfer out of said common wall of said adjoining cylinders.

* * * * *